United States Patent [19]

Sayles

[11] Patent Number: 5,015,310

[45] Date of Patent: May 14, 1991

[54] EMBEDDED EXPLOSIVES AS BURNING RATE ACCELERATORS FOR SOLID PROPELLANTS

[75] Inventor: David C. Sayles, Huntsville, Ala.

[73] Assignee: The United States of America as represented by the Secretary of the Army, Washington, D.C.

[21] Appl. No.: 593,428

[22] Filed: Oct. 4, 1990

[51] Int. Cl.[5] ..... C06B 45/10

[52] U.S. Cl. ..... 149/19.9; 149/19.4; 149/42; 149/76; 149/88

[58] Field of Search ..... 149/19.4, 19.9, 42, 149/76, 88

[56] References Cited

U.S. PATENT DOCUMENTS

| | | | |
|---|---|---|---|
| 3,798,090 | 3/1974 | Anabashi | 149/19.4 |
| 4,092,189 | 5/1978 | Betts | 149/19.2 |
| 4,441,942 | 4/1984 | Sayles | 149/19.6 |
| 4,530,728 | 7/1985 | Sayles | 149/19.6 |
| 4,655,858 | 4/1987 | Sayles | 149/19.2 |
| 4,952,254 | 8/1990 | Betts et al. | 149/19.4 |

*Primary Examiner*—Stephen J. Lechert, Jr.
*Attorney, Agent, or Firm*—Freddie M. Bush

[57] ABSTRACT

A method of achieving an ultrahigh-burning rate composite solid propellant through the embedment of the solid explosive diazodinitrophenol (e.g., 2-diazo-4,6-dinitrophenol) having predetermined shapes and dimensions of cubes or pellets. Cubes having dimension from about 1/16 inch to about 3/32 inches on each side and pellets having dimensions from about 1/16 inch to about 3/32 inch diameters are employed in weight percent ranging from about 1 to about 5 with an uncured composite solid propellant composition in a weight percent range from about 95 to about 99. After being uniformly blended in the uncured state, the propellant and solid explosive are cured to a solid grain which has an increase in burning rate with about a 4.5 weight percent concentration of diazodinitrophenol of about 4.5 composite solid propellant composition with 0% diazodinitrophenol burned at 0.6 inches per second. A typical composite solid propellant composition has a range of hydroxy-terminated polybutadiene binder with an added polyisocyanate curative of about 1 weight percent from about 9 to about 12 weight percent, a range of ammonium perchlorate oxidizer from about 65 to about 78 weight percent, and a range of aluminum metal fuel from about 10 to about 20 weight percent.

4 Claims, 1 Drawing Sheet

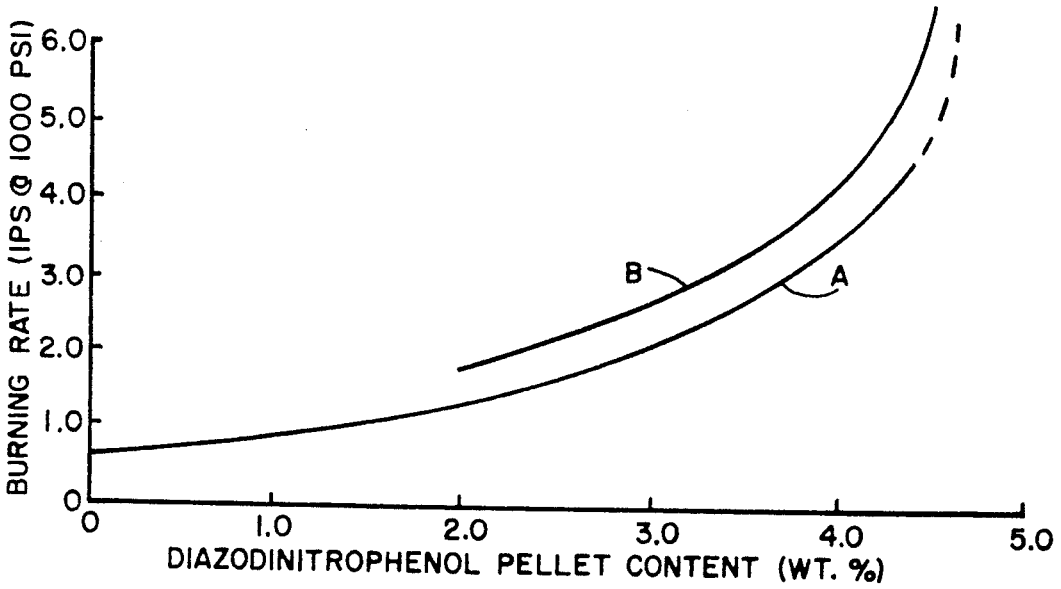
BURNING RATE (IPS @ 1000 PSI)
6.0
5.0
4.0
3.0
2.0
1.0
0
B
A
0
1.0
2.0
3.0
4.0
5.0
DIAZODINITROPHENOL PELLET CONTENT (WT. %)

EMBEDDED EXPLOSIVES AS BURNING RATE ACCELERATORS FOR SOLID PROPELLANTS

The invention described herein may be manufactured, used, and licensed by or for the Government for governmental purposes without the payment to me of any royalties thereon.

BACKGROUND OF THE INVENTION

Metal has been used to enhance the burning rate of solid propellant compositions. The metal has been added to uncured solid propellant compositions in various forms, e.g., ribbons, powder, staples, spheroidal, and other geometric shapes.

Metallic compounds in the forms of ferrocenes or carboranes have also been used as burning rate enhancers. Examples of each of these compounds are n-butylferrocene and n-hexylcarboranes. Derivatives of ferrocenes and carboranes have been employed. An example of a very expensive ferrocene derivative is known as Catocene, the registered trademark for Syntex Chemicals, Inc. 2,2 bis(ethylferrocenyl)propane ($C_{27}H_{32}Fe_2$). The cost of Catocene of about $250 per pound is based on the fact that it is a specialty chemical, manufactured in limited quantities, and it is difficult to prepare at the required level of purity. Catocene has functioned as a burning rate accelerator, but as a result of special problems associated with its use, another burning rate accelerator has been sought which does not contribute to the problem areas described below.

Catocene, because it is a liquid, migrates out of propellants. This loss of progressive reduction in the propellant's burning rate is a result of Catocene migration. One approach to preventing migration is establishing an equilibrium concentration of Catocene in the propellant and insulation. As a consequence of trying to establish this equilibrium condition, five times as much Catocene needs to be compounded into a liner as is incorporated into the propellant. As a result of the high Catocene content of the liner, in an effort to establish an equilibrium condition for the propellant, the liner ceases to be a true liner and will burn producing dense smoke. The dense smoke generated due to lack of oxidizer or oxygen (such as is present in the propellant), makes detection of the missile, while in flight, an easy task. The advantages of a burning rate accelerator which does not produce the above described undesirable results are readily recognized, especially for use in a tactical missile system where concealment is a necessity. Therefore, an object of this invention is to provide a solid explosive in a predetermined amount and of a predetermined pellet particle size for use in combination with solid composite propellant compositions to achieve ultrahigh burning rate.

Another object of this invention is to provide a burning rate accelerator which is compatible with typical solid composite propellant ingredients and which is readily ignited when embedded in the solid composite propellant composition.

BRIEF DESCRIPTION OF THE DRAWING

The FIGURE of the Drawing depicts Curves A and B for burning rates in inches per second for varied weight of percents of diazodinitrophenol contents of 1/16 inch and 3/32 inch pellet sizes respectively.

SUMMARY OF THE INVENTION

Burning rate acceleration for a solid composite propellant composition is achieved by pressing diazodinitrophenol (a solid explosive) into pellet cubes of typical dimensions of 3/32 inch X 3/32 inch by 3/32 inch. Solid composite propellant composite sample containing variable, predetermined amounts of the above identified solid explosive, diazodinitrophenol, when burned at 500 and 1000 psi increased the burning rate of propellant as the concentration of the diazodinitrophenol is increased. Burning rate undergoes increases as the pellet particle size is increased. There is an apparent limit to the size of diazodinitrophenol pellets that can be used because the burning rate becomes too vigorous and violent when the larger size pellets are used. Burning rates measured for 1/16 inches particle size approached 4.5 inches per second at 1000 psi with weight percent of about 4.5. Higher burning rates were achieved with pellets which were 3/32 inch pellet size, e.g., about 6.5 inches per second.

Burning rate enhancement of a typical aluminized, diazodinitrophenol-catalyzed, ammonium perchlorate-oxidized, polybutadiene prepolymer propellant increased from approximately 0.6 inches per second at 0 weight percent diazodinitrophenol to 4.5 inches per second at 4.5 weight percent diazodinitrophenol content with 1/16 inch pellets.

DESCRIPTION OF THE PREFERRED EMBODIMENT(S)

Diazodinitrophenol which has the chemical name 2-diazo-4,6-dinitrophenol and the corresponding structural chemical formula shown below, is pressed into pellet cubes of dimensions of about 1/16 inch diameter to about 3/32 inch diameter. These pellets are embedded in a solid composite propellant composition to enhance the burning rate of the solid composite propellant composition which contains aluminum fuel, ammonium perchlorate oxidizer and polybutadiene prepolymer crosslinked with isophorone diisocyanate.

STRUCTURAL CHEMICAL FORMULA OF 2-DIAZO-4,6-DINITROPHENOL

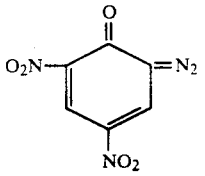

In further reference to the single FIGURE of the Drawing, the burning rate curves show that the burning rates undergo a near-consistent increase in burning rate as the concentration of the diazodinitrophenol is increased. The described relationship is true when burned in a window bomb at 500- and 1000-psi. The relationship between pellet particle size and burning rate enhancement is observed to be that the larger the pellet size the more will be the enhancement of the burning rate. For example, burning rates approaching 4.5 inches per second at 1000 psi were achieved with diazodinitrophenol pellets of 1/16 inch diameter size, Curve A. Higher burning rates of about 6.5 inches per second were achieved with pellets which were 3/32 inch diameter size, Curve B. There is an apparent limit to the size of diazodinitrophenol pellets that can be used because of the burning rate becoming too vigorous and violent with the pellets larger than 3/32 inch diameter size.

Burning rate enhancement of a typical aluminized, diazodinitrophenol catalyzed, ammonium perchlorate oxidized, isophorone diisocyanate-crosslinked hydroxyl-terminated polybutadiene prepolymer propellant (further described hereinbelow), as determined in a window bomb, is presented in Tables I and II below and depicted graphically in the single FIGURE of the Drawing.

A typical composite solid propellant composition is comprised of about 9–12 weight percent of hydroxyl-terminated polybutadiene binder system including a polyisocyanate curative as an additive of up to about 1 weight percent, an ammonium perchlorate oxidizer in an amount from about 65 to about 78 weight percent, and an aluminum metal fuel in an amount from about 10 to about 20 weight percent. A range from about 95 to about 99 weight percent of the uncured composite solid propellant composition which is in a uniformly dispersed heterogeneous-mixed state is employed with from about 1 to about 5 weight percent of the burn rate accelerator, diazodintrophenol, which is blended to a heterogeneous mixture and cured to yield an ultrahigh burning rate composite solid propellant grain.

TABLE I

Burning Rate of Diazodinitrophenol Catalyzed Propellant

| Burning Rate (Inches per second at 1000 psi) | Pellet Size (inch) | Weight Percent of Diazodinitrophenol |
|---|---|---|
| 0.6 | — | 0 |
| 1.0 | 1/16 | 1.5 |
| 1.4 | 1/16 | 2.0 |
| 2.0 | 1/16 | 3.0 |
| 3.5 | 1/16 | 4.0 |

TABLE II

Burning Rate of Diazodinitrophenol Catalyzed Propellant

| Burning Rate (Inches per Second at 1000 psi) | Pellet Size (inch) | Weight Percent of Diazodinitrophenol |
|---|---|---|
| 0.6 | — | 0 |
| 1.8 | 3/32 | 2.0 |
| 2.8 | 3/32 | 3.0 |
| 6.5 | 3/32 | 4.5 |

The following additional information about diazodinitrophenol denotes the attractiveness of this chemical as a burning rate accelerator, especially, as compared to the one other burning rate acelerator which is the chemical compound 2,2-bis(ethylferrocenyl)propane (Catocene).

1. Diazodintrophenol is available commercially as a solid chemical that is readily pressed into pellets of predetermined sizes.

2. The pressed pellets are uniformly dispersed throughout the propellant composition by standard propellant formulation procedures to achieve a uniform dispersion.

3. Since the pressed pellets are of a solid chemical composition, there is no migration problem as contrasted with Catocene which undergoes migration.

4. The ready available low cost ($20 per pound as contrasted to $250 per pound for Catocene) makes diazodinitrophenol pellets particularly attractive for use as a burning rate enhancer. 5. Ignition of the propellant which incorporates diazodinitrophenol is effected in the same manner as other propellants, and that is, by means of an igniter. 6. The other available burning rate accelerators, such as solid ferric oxide, lack the ability to yield the high burning rates of the level obtained by the use of diazodinitrophenol.

I Claim:

1. A method of achieving an ultrahigh-burning rate for a composite solid propellant composition comprised of a hydroxyl-terminated polybutadiene binder system including an polyisocyanate curative as an additive of up to about 1 weight percent, an ammonium perchlorate oxidizer, and an aluminum metal fuel, said method comprising:

(i) providing said composite solid propellant composition in an uncured homogeneously mixed state which comprises a weight percent range from about 95 to about 99 of said ultrahigh burning rate composite solid propellant composition;

(ii) providing a solid explosive composition of diazodinitrophenol of predetermined shapes and dimensions of cubes or pellets, said dimension when of a cube shape being from about 1/16 inch to about 3/32 inch on each side, and said dimension when of a pellet shape being from about 1/16 inch to about 3/32 inch diameter;

(iii) adding a predetermined amount from about 1 weight percent to about 5 weight percent of said diazodinitrophenol to said weight percent ranges of said uncured homogeneously mixed composite solid propellant composition;

(iv) mixing said uncured uniformly mixed composite solid propellant composition with said added amount of said diazodinitrophenol to achieve a homogenous mixture; and, (v) curing said uncured uniformly mixed composite solid propellant containing said diazodinitrophenol to yield an ultrahigh-burning rate composite solid propellant grain wherein said diazodinitrophenol functions as a burn rate accelerator.

2. The method of achieving ultrahigh-burning rate for a composite solid propellant composition as defined in claim 1 where in said diazodinitrophenol is 2-diazo-4,6-dinitrophenol and wherein said hydroxyl-terminated polybutadiene binder system is present in an amount from 9 to about 12 weight percent, said ammonium perchlorate oxidizer is present in an amount from about 65 to about 78 weight percent, and said aluminum metal fuel is present is an amount from about 20 weight percent.

3. The method of achieving ultrahigh burning rate for a composite solid propellant composition as defined in claim 2 wherein said 2-diazo-4,6-dinitrophenol is employed in said predetermined shape of pellets with dimension of 1/16 inch diameter and in said predetermined amount of about 4.5 weight percent to produce a burning rate increase from about 0.6 inches per second at 0 weight percent of said 2-diazo-4,6-dinitrophenol to about 4.5 inches per second with said weight percent of said 2-diazo-4,6-dinitrophenol.

4. The method of achieving ultrahigh-burning rate for a composite solid propellant composition as defined in claim 2 wherein said 2-diazo-4,6-dinitrophenol is employed in said predetermined shape of cubic pellets with dimension of 3/32 inch on each side and in said predetermined amount of about 4.5 weight percent to produce a burning rate increase from about 0.6 inches per second at 0 weight percent of said 2-diazo-4,6-dinitrophenol to about 6.5 inches per second with said weight percent of said 2-diazo-4,6-dinitrophenol.

* * * * *